US011795644B2

(12) United States Patent
Abeles

(10) Patent No.: US 11,795,644 B2
(45) **Date of Patent: *Oct. 24, 2023**

(54) FLOOD BARRIER

(71) Applicant: Gary E. Abeles, Verona, NJ (US)

(72) Inventor: Gary E. Abeles, Verona, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/551,467

(22) Filed: Dec. 15, 2021

(65) Prior Publication Data

US 2022/0106752 A1 Apr. 7, 2022

Related U.S. Application Data

(63) Continuation-in-part of application No. 17/481,801, filed on Sep. 22, 2021, now Pat. No. 11,479,930, which is a continuation-in-part of application No. 17/179,048, filed on Feb. 18, 2021, now Pat. No. 11,149,393, which is a continuation-in-part of application No. 16/904,047, filed on Jun. 17, 2020, now Pat. No. 10,954,641, which is a continuation-in-part of application No. 16/480,476, filed as application No. PCT/US2018/012781 on Jan. 8, 2018, now Pat. No. 10,718,095.

(60) Provisional application No. 62/451,394, filed on Jan. 27, 2017.

(51) Int. Cl.
*E02B 3/04* (2006.01)
*E02B 3/10* (2006.01)

(52) U.S. Cl.
CPC ..... *E02B 3/108* (2013.01)

(58) Field of Classification Search
CPC ..... E02B 3/04; E02B 3/06; E02B 3/108
See application file for complete search history.

(56) References Cited

U.S. PATENT DOCUMENTS

| | | | |
|---|---|---|---|
| 2,474,786 | A | 6/1949 | Humphrey |
| 3,280,569 | A | 10/1966 | Wosenitz |
| 3,386,250 | A | 6/1968 | Susumu |

(Continued)

FOREIGN PATENT DOCUMENTS

| | | |
|---|---|---|
| CN | 202280039 U | 6/2012 |
| WO | 2006031525 A2 | 3/2006 |

OTHER PUBLICATIONS

Notice of Allowance for U.S. Appl. No. 17/481,801 dated Jun. 20, 2022, 7 pages.

(Continued)

*Primary Examiner* — Benjamin F Fiorello
(74) *Attorney, Agent, or Firm* — Maine Cernota & Curran

(57) ABSTRACT

A flood barrier module that is light, easy to install, easy to remove or stow, and resistant to softening of underlying ground includes an inclined front wall penetrated by holes near a top thereof, as well as side walls, a rear wall, and a base wall, which together surround a substantially watertight interior. The module is initially anchored by its own weight and/or by stakes or similar means. When impacted by flood waters that rise higher than the holes, the module is filled with flood water that is retained within the interior, such that the weight of the retained water anchors it to the ground, even if the ground becomes softened. Embodiments can be folded or disassembled and stacked into a flat, stowed configuration. The module can be installed in a sump or pit, and can be at or below grade when stowed.

18 Claims, 10 Drawing Sheets

(56) References Cited

U.S. PATENT DOCUMENTS

| | | | | |
|---|---|---|---|---|
| 3,653,216 | A | 4/1972 | Stickler, Jr. | |
| 3,844,125 | A | 10/1974 | Williams, Sr. | |
| 4,129,006 | A | 12/1978 | Payne | |
| 4,367,978 | A | 1/1983 | Schaaf et al. | |
| 4,479,740 | A | 10/1984 | Schaaf | |
| 4,711,598 | A | 12/1987 | Schaaf | |
| 4,726,708 | A | 2/1988 | Papetti | |
| 4,818,141 | A | 4/1989 | Rauch | |
| 4,978,247 | A | 12/1990 | Lenson | |
| 5,102,257 | A | 4/1992 | Creter | |
| 5,176,468 | A | 1/1993 | Poole | |
| 5,405,217 | A | 4/1995 | Dias | |
| 5,564,369 | A | 10/1996 | Barber | |
| 5,655,851 | A | 8/1997 | Chor | |
| 5,791,827 | A | 8/1998 | Arvai | |
| D417,314 | S | 11/1999 | Smith, Jr. | |
| 6,061,975 | A * | 5/2000 | Craft, Jr. | H02G 9/10 405/303 |
| 6,334,736 | B1 * | 1/2002 | Johnson | E02B 3/108 405/114 |
| 6,565,283 | B1 | 5/2003 | Hall | |
| 6,616,383 | B2 | 9/2003 | Janz | |
| 6,672,799 | B2 | 1/2004 | Earl | |
| 7,384,217 | B1 | 6/2008 | Barret | |
| 7,708,495 | B1 * | 5/2010 | Antee | E02B 3/108 405/15 |
| 8,226,325 | B1 | 7/2012 | Pierce, Jr. | |
| 8,585,318 | B1 | 11/2013 | Walker | |
| 8,747,023 | B1 | 6/2014 | Walker | |
| 9,157,204 | B2 | 10/2015 | Pierce, Jr. | |
| 10,718,095 | B2 | 7/2020 | Abeles | |
| 2001/0026735 | A1 | 10/2001 | Price | |
| 2006/0056913 | A1 | 3/2006 | Herzog | |
| 2006/0159518 | A1 | 7/2006 | Cravens | |
| 2006/0275081 | A1 | 12/2006 | Medina Folgado | |
| 2009/0154996 | A1 | 6/2009 | Liner | |
| 2010/0310313 | A1 | 12/2010 | Kohlenberg | |
| 2016/0348327 | A1 | 12/2016 | Martin | |
| 2017/0342673 | A1 | 11/2017 | O'Sullivan | |

OTHER PUBLICATIONS

Office Action for U.S. Appl. No. 17/481,801 dated Jun. 22, 2022, 16 Pages.

PCT International Search Report and Written Opinion for Appl No. PCT/US2018/012781 dated Apr. 27, 2018, 12 pages.

International Preliminary Report on Patentability for Appl No. PCT/US2018/012781 dated Jul. 30, 2019, 8 pages.

Office Action for U.S. Appl. No. 16/904,047, dated Aug. 20, 2020, 8 Pages.

Notice of Allowance for U.S. Appl. No. 16/904,047, dated Nov. 25, 2020, 10 Pages.

Office Action for Chinese Patent Appl. No. 201880008696.9, dated Oct. 20, 2020, 9 Pages.

Notice of Allowance for U.S. Appl. No. 17/179,048 dated Jun. 23, 2021, 13 pages.

Foreign Office Action for Patent Application No. 201880008696.9, dated May 17, 2021, 11 pages.

* cited by examiner

FLOOD BARRIER

RELATED APPLICATIONS

This application is a continuation in part of U.S. application Ser. No. 17/481,801, filed on Sep. 22, 2001. Application Ser. No. 17/481,801 is a continuation in part of U.S. application Ser. No. 17/179,048 filed on Feb. 18, 2021, now U.S. Pat. No. 11,149,393. Application Ser. No. 17/179,048 is a continuation in part of U.S. application Ser. No. 16/904,047 filed on Jun. 17, 2020, now U.S. Pat. No. 10,954,641. U.S. application Ser. No. 16/904,047 is a continuation in part of U.S. application Ser. No. 16/480,476, filed on Jul. 24, 2019, now U.S. Pat. No. 10,718,095. Application U.S. Ser. No. 16/480,476 is a national phase application of PCT application PCT/US2018/012781, filed on Jan. 8, 2018. Application PCT/US2018/012781 claims the benefit of U.S. Provisional Application No. 62/451,394, filed Jan. 27, 2017. All of these applications are herein incorporated by reference in their entirety for all purposes.

FIELD OF THE INVENTION

The invention relates to apparatus and methods of containing flood waters, and more particularly to apparatus and methods of containing flood waters that can be implemented on a temporary basis.

BACKGROUND OF THE INVENTION

Floods can be devastating to "fixed" assets that cannot be easily moved out of harm's way, such as houses and crops. Generally, it is possible to determine whether a given location is in a "flood zone," i.e. a region that is in danger of flooding. However, warning that a flood is imminent is typically not received more than a few days in advance, and sometimes only a few hours in advance.

One approach is to erect a permanent dike or other flood barrier. However, there are many circumstances where it is not desirable to maintain a permanent or semi-permanent flood barrier, for example immediately in front of a home or business, or surrounding a crop region that is under cultivation.

Another approach is to erect a temporary flood barrier that is fixed to the ground by spikes or similar means. However, while such barriers might be initially effective, they can eventually fail due to water saturation and softening of the underlying ground.

A more common approach to blocking flood waters is to erect a barrier made from bags of dirt or sand. Instead of being anchored to the underlying ground, these "sandbag" barriers rely on their weight to enable them to withstand the pressure of flood waters. Sandbag barriers thereby offer the advantage of being largely unaffected by water saturation and softening of the underlying ground.

Unfortunately, due to the heavy weight of sandbags, it can be difficult, expensive, and time consuming to erect, and later to remove, such barriers. Instead, a sandbag barrier is often left in place until a more permanent barrier can be erected.

What is needed, therefore, is a flood barrier that is light in weight, easy and inexpensive to install, easy to remove or stow, and resistant to softening of the underlying ground.

SUMMARY OF THE INVENTION

The present invention is a flood barrier that is light in weight, easy and inexpensive to install, easy to remove or stow, and resistant to softening of the underlying ground. In the short term, the barrier is anchored to the ground by its own weight, and/or by stakes or similar means. When the barrier is impacted by a flood, however, it is filled with flood water, which is retained within the barrier as the flood recedes. As a result, the weight of the retained water within the barrier anchors it to the ground, even if the ground becomes softened, in a similar manner to a sandbag barrier. Unlike a sandbag barrier, however, once the flood is over, the contained water can easily be released, rendering the barrier easy to remove or to stow.

More specifically, the disclosed apparatus comprises a rigid or semi-rigid front wall that is penetrated by a plurality of holes in an upper region thereof. In embodiments, the front wall has a thickness that is between one quarter inch and two inches. The holes can have diameters that are between ¼ inch and 6 inches. The front wall is inclined inward at an angle of at least 20 degrees from vertical, so that the pressure of flood waters against the front of the barrier will be directed partially downward, thereby helping to maintain the barrier in position. As the flood water rises, it reaches the holes, causing water to enter through the holes into an interior of the apparatus behind the front wall.

The apparatus further comprises a rear wall, a bottom wall, and two side walls, which create a fully enclosed interior within which the water that enters through the holes is retained, even after the level of the flood has fallen below the holes. In embodiments, at least one of the front wall, the rear wall, the side walls, and the bottom comprises at least one of plywood, metal, fiberglass, particle board, microlattice, rigid foam, Styrofoam, graphene, and/or plastic. A plurality of the disclosed barriers can be joined end-on-end to provide a more extended barrier, and/or to surround a house, field of cultivation, or other fixed asset that might be subject to flood waters from more than one direction.

In embodiments, the front, rear, and side walls are removable or hinged, so that the barrier can be folded or disassembled and stacked in a substantially flat configuration when it is not needed, rather than being physically removed.

In lieu of, or in addition to, stakes and/or other anchoring means, the stability of the barrier can be enhanced by placing it into a shallow pit. In some of these embodiments, the barrier can be folded or disassembled when not in use, such that it can be stowed in the pit below ground. A lid can then be placed over the cover having a top that is substantially flush with the surrounding grade. As a result, when the barrier is stowed in the pit, it can be walked on or in embodiments even driven over with a vehicle, such as a tractor pulling farm equipment.

One general aspect of the present invention is a flood containment barrier module that includes a front wall having a top, a bottom, and two sides, the front wall being inclined backward at an angle of at least 20 degrees from vertical, a plurality of holes penetrating the barrier wall proximate the top thereof, a rear wall having a top, a bottom, and two sides, two side walls having left and right edges that are joined to the sides of the front and rear walls, and a base wall joined to the bottoms of the front and rear walls and the side walls, so that a substantially watertight chamber space is formed between and bounded by the front and rear walls, the side walls, and the base wall. The module is configured such that flood waters in contact with the front wall will flow into the interior when a height of the flood waters exceeds a height of the plurality of holes, the interior being thereby filled with water that is retained when the height of the flood waters falls below the plurality of holes, a weight of the retained water serving to increase a resistance of the module to being laterally displaced by the flood waters.

Embodiments further include at least one anchor that forms an attachment between the barrier module and ground proximate the barrier module. In some of these embodiments the at least one anchor is at least one stake that can be driven into the ground.

In any of the above embodiments, the rear wall can be inclined from vertical in a forward direction, so that the top of the rear wall is in contact with the top of the front of the front wall, or with a rear surface of the front wall.

In any of the above embodiments, a thickness of the front wall can be between one quarter inch and two inches.

In any of the above embodiments, at least one of the front wall, the rear wall, the side walls, and the base wall can be made from plywood, metal, fiberglass, particle board, microlattice, rigid foam, Styrofoam, graphene, and/or plastic.

In any of the above embodiments, the holes can have diameters that are between ¼ inch and 6 inches.

In any of the above embodiments, the front wall, the rear wall, and the side walls can be detachable from each other and can be pivotable about their bottoms so as to overlap with each other in a substantially flat, stowed configuration.

In any of the above embodiments, the front wall, the rear wall, the side walls, and the base wall can be detachable from each other and stackable on top of each other in a substantially flat, stowed configuration.

In any of the above embodiments, the module is configured for installation within a sump or pit. In some of these embodiments the front wall, the rear wall, and the side walls can overlap with each other in a substantially flat, stowed configuration that lies even with or below a surrounding grade. In some of these embodiments, when the barrier module is in the stowed configuration it is below grade, and the barrier module further comprises a lid that is configured to cover the sump or pit. And in some of these embodiments when the lid is covering the sump or pit, a top of the lid is substantially even with the surrounding grade.

A second general aspect of the present invention is a flood containment structure that includes a plurality of barrier modules. Each of the barrier modules includes a front wall having a top, a bottom, and two sides, the front wall being inclined backward at an angle of at least 20 degrees from vertical, a plurality of holes penetrating the barrier wall proximate the top thereof, a rear wall having a top, a bottom, and two sides, an interior of the barrier module being formed between the front and rear walls, and a base wall joined to the bottoms of the front and rear walls. The barrier module is configured such that flood waters in contact with the front wall will flow into the interior when a height of the flood waters exceeds a height of the plurality of holes, the interior being thereby filled with water that is retained when the height of the flood waters falls below the plurality of holes. The modules are arranged side-by-side and joined to each other by substantially watertight seals, such that the plurality of modules are combined into an extended flood barrier.

In embodiments, the side walls are closer to each other than opposing sides of the front and rear walls and bottom, such that the front and rear walls and the base wall extend beyond the side walls. In some of these embodiments, at least one adjacent pair of the plurality of modules are joined together by a gasket into which sides of the front and rear walls and the bottom are inserted.

In any of the above embodiments, at least some of the modules can further comprise at least one side wall having left and right edges that are joined to the sides of the front and rear walls And in any of the above embodiments, at least some of the modules lack side walls, such that a common interior space is formed between the modules when they are joined to each other.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

The present invention is a flood barrier that is light in weight, easy and inexpensive to install, easy to remove and/or stow, and resistant to softening of the underlying ground. In the short term, the barrier is anchored to the ground by its own weight, and/or by stakes or similar means. When the barrier is impacted by a flood, however, it is filled with flood water, which is retained within the barrier as the flood recedes. As a result, the weight of the retained water within the barrier anchors it to the ground, even if the ground becomes softened, in a similar manner to a sandbag barrier. Unlike a sandbag barrier, however, once the flood is over, the contained water can easily be released, rendering the barrier easy to remove or to stow.

Figure 1A:
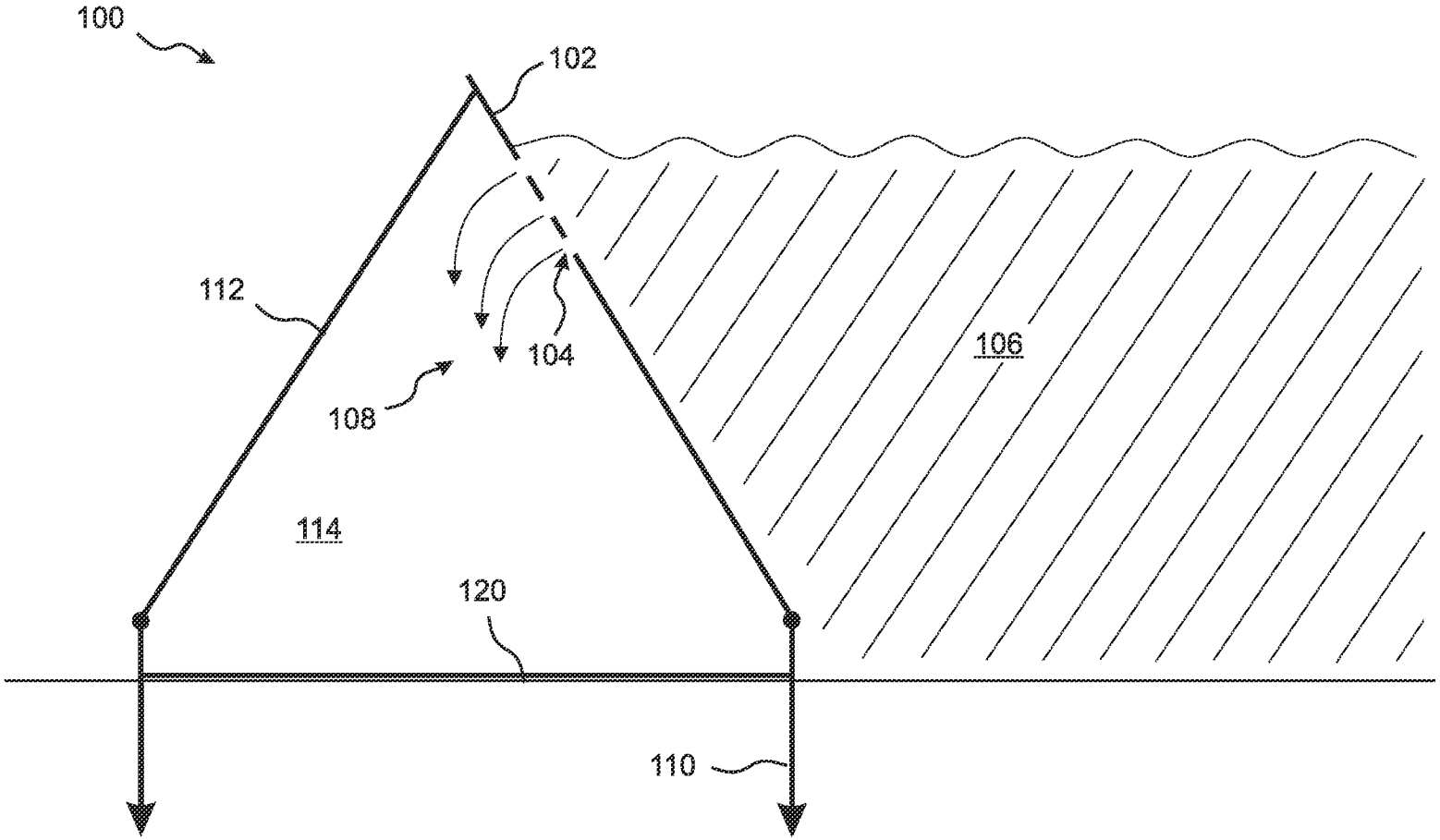
FIG. 1A is a cross-sectional view of an embodiment of the invention shown after flood waters initially rise higher than the holes.

With reference to FIG. 1A, the disclosed apparatus 100 comprises a rigid or semi-rigid front wall 102 that is penetrated by a plurality of holes 104 in an upper region thereof. The holes can have diameters that are between ¼ inch and 6 inches. When deployed, the barrier 100 is anchored to the ground by stakes 110, and the front wall 102 is inclined backward at an angle of at least 20 degrees from vertical, so that the pressure of flood waters 106 against the front wall 102 will be directed partially downward, thereby further helping to maintain the barrier 100 in position. As the flood water rises, it reaches the holes 104, causing water to enter 108 through the holes 104 into an interior 114 of the apparatus 100 behind the front wall 102.

Figure 1B:
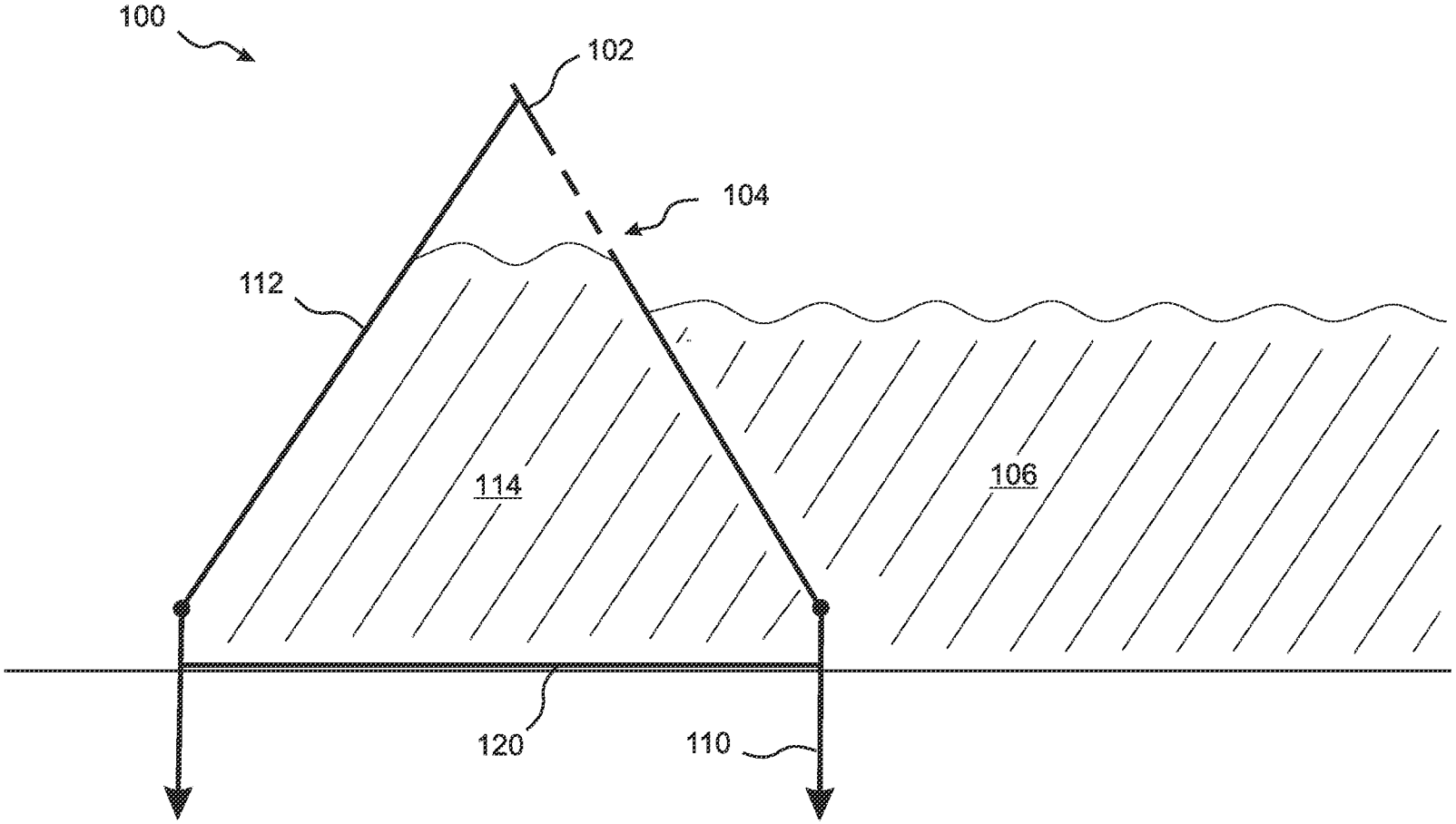
FIG. 1B is a cross-sectional view of the embodiment of FIG. 1A shown after flood waters have filled the barrier interior and the flood has subsequently receded.
Figure 1C:
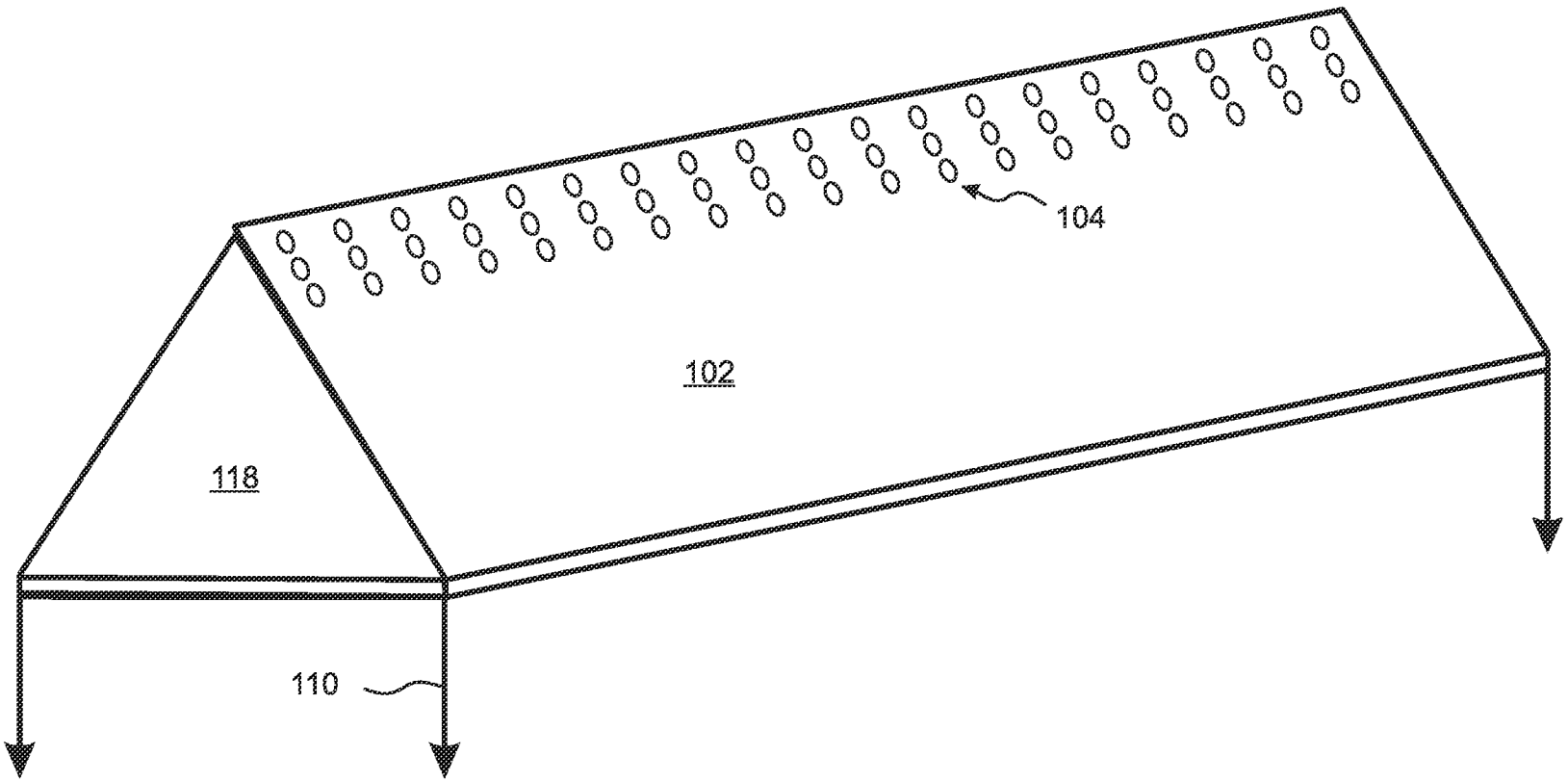
FIG. 1C is a perspective view of the embodiment of FIGS. 1A and 1B.

The apparatus further comprises a rear wall 112, a bottom wall 120 and two side walls 118 (shown in FIG. 1C), which create a fully enclosed interior 114. In embodiments, at least one of the front wall 102, the rear wall 112, the side walls 118, and the bottom 120 comprises at least one of plywood, metal, fiberglass, particle board, micro-lattice, rigid foam, Styrofoam, graphene, and/or plastic. With reference to FIG. 1B, even after the level of the flood 106 has fallen below the holes 104, the water 108 that has entered into the barrier 100 through the holes 114 is retained within the interior 114. The weight of this retained water maintains the barrier in position, even if the underlying ground becomes water saturated and softened, such that the stakes 110 are less effective. FIGS. 1A and 1B are cross-sectional views of the illustrated embodiment, whereas FIG. 1C is a perspective view of the illustrated embodiment.

Figure 1D:
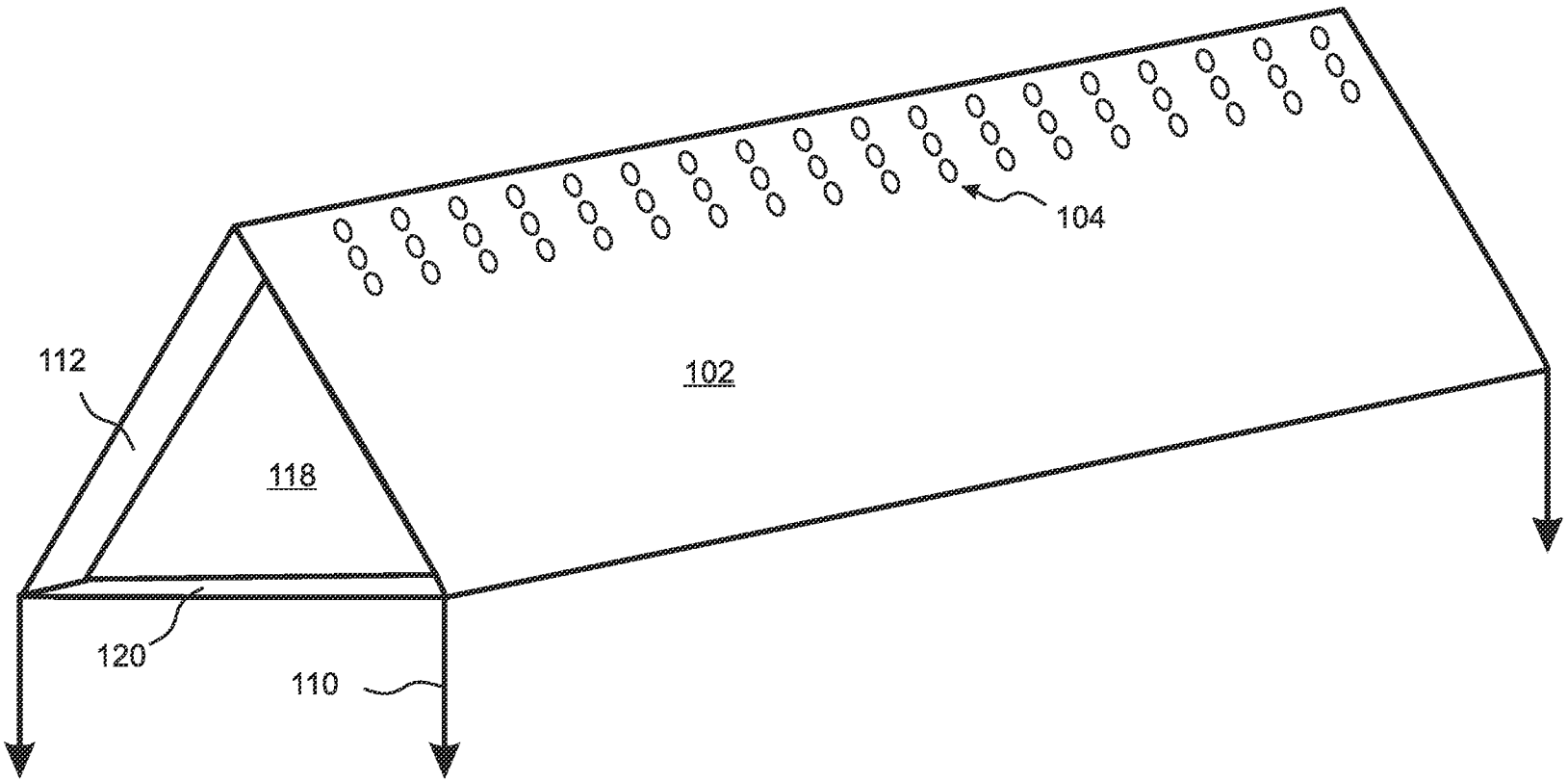
FIG. 1D is a perspective view of an embodiment similar to FIG. 1C, in which the side walls are closer to each other than opposing sides of the front and rear walls and bottom, such that the front and rear walls and the base wall extend beyond the side walls.

With reference to FIG. 1D, in embodiments the side walls 118 are closer to each other than opposing sides of the front 102 and rear 112 walls and bottom 120, such that the front 102 and rear 112 walls and the base wall 120 extend beyond the side walls 118. In some of these embodiments, at least one adjacent pair of a plurality of modules 100 are joined together by a gasket into which sides of the front 102 and rear 112 walls and the bottom 120 are inserted.

Figure 2A:
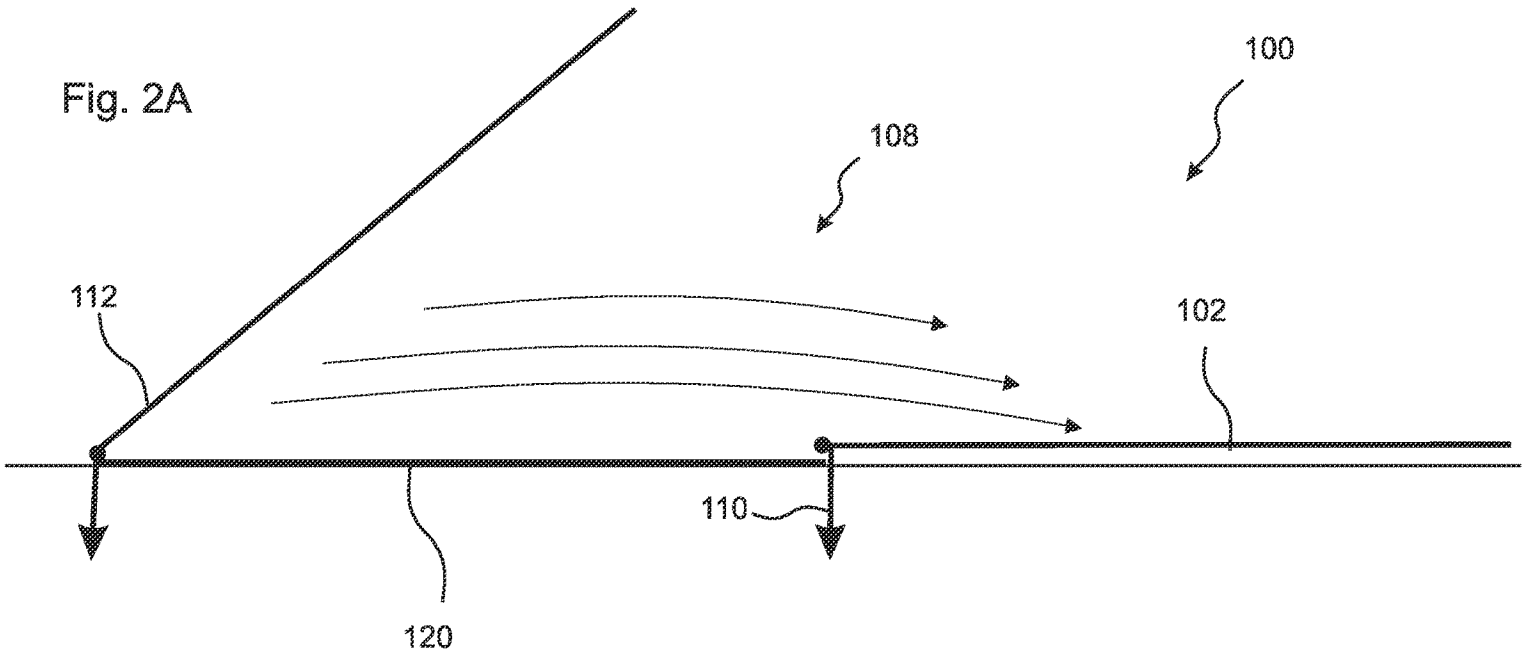
FIG. 2A is a cross-sectional view of an embodiment in which the front and rear walls and the side walls can be pivoted about their bottoms to form a substantially flat stack, the embodiment being illustrated with the front wall folded outward to release water from the interior.
Figure 2B:
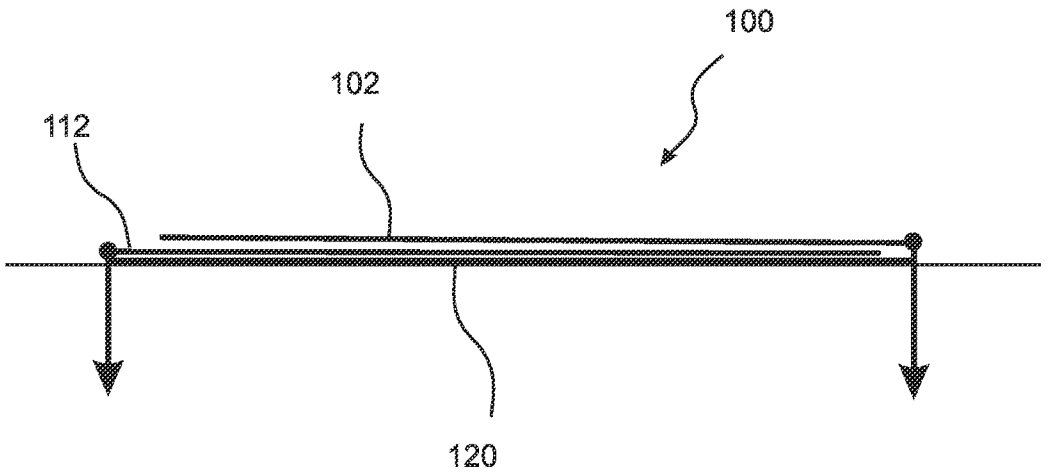
FIG. 2B is a cross-sectional view of the embodiment of FIG. 1A illustrated in its stowed configuration after the water has been drained from the interior.

With reference to FIGS. 2A and 2B, in embodiments the front 102 and rear 112 walls are sealed to each other by a removal means such as by gaskets, and can be detached from each other and from the sidewalls 118. In embodiments, the barrier 100 can be stowed in place as an alternative to being physically removed In the illustrated embodiment the front 102, rear 112, and side 118 walls are hinged to the bottom 120 at their lower edges, so that the barrier 100 can be folded into a substantially flat configuration when it is not in use. In similar embodiments, the front 102, rear 112, and side 118 walls are detachable from the bottom, and can be stacked flat on top of each other in a stowed configuration.

In FIG. 2A, the front wall 102 has been detached from the rear wall 112 and side walls 118, and has been folded outward away from the barrier 100, thereby allowing the retained water 108 to drain from the interior 114 of the barrier 100. In FIG. 2B, all of the walls 102, 112, 118, have been folded inward so as to collapse the barrier 100 into a substantially flat, stowed configuration.

Figure 3A:
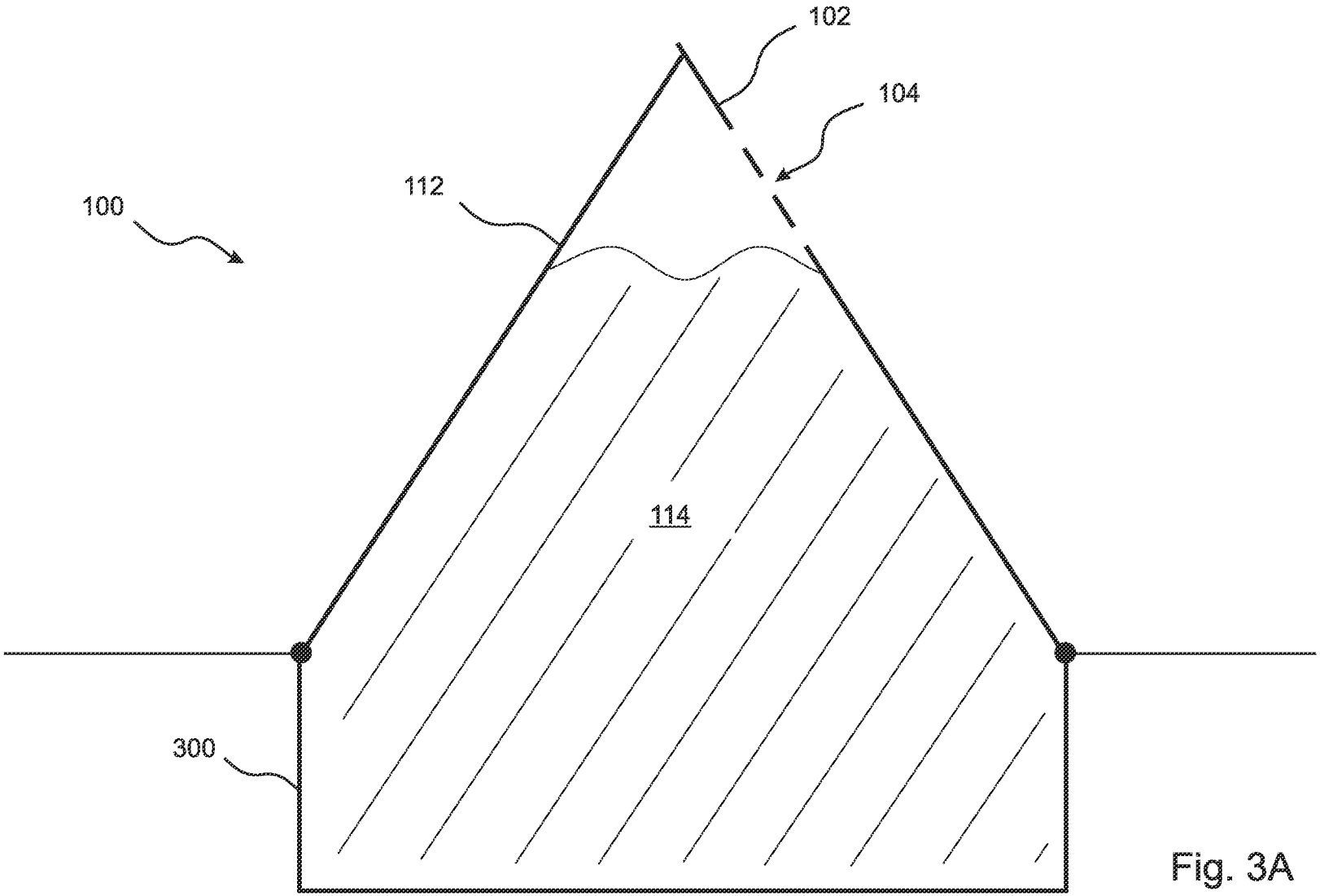
FIG. 3A is cross-sectional view of an embodiment that is installed in a sump or pit.
Figure 3B:
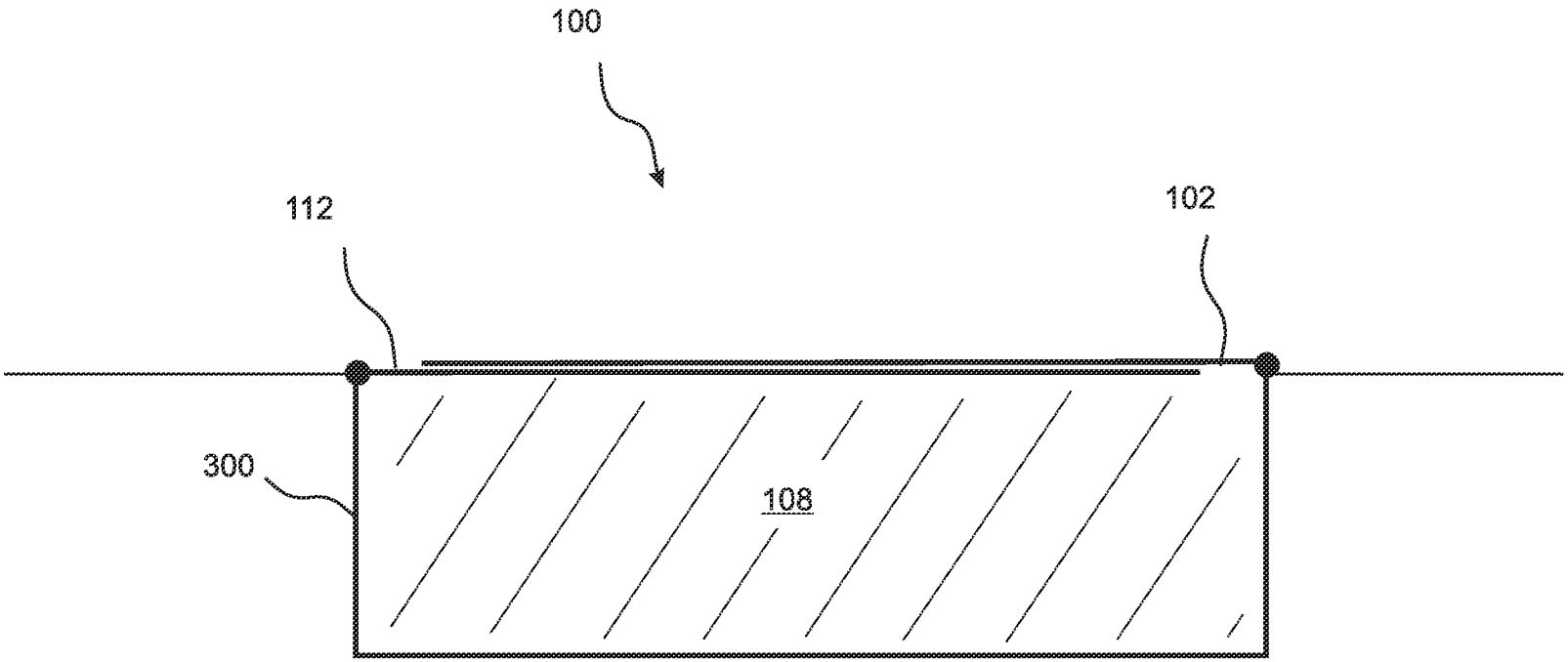
FIG. 3B is a cross-sectional view of the embodiment of FIG. 3A, shown in is stowed configuration.

With reference to FIG. 3A, in lieu of, or in addition to, stakes 110 and/or other anchoring means, the stability of the barrier can be enhanced by placing it into a shallow pit 300 or sump below grade. In the embodiment of FIG. 3A, the front 102, rear 112, and side 118 walls are hinged and can be folded into a substantially flat configuration that is approximately flush with the surrounding grade, as illustrated in FIG. 3B. In FIG. 3B, the water 108 that was above grade within the interior 114 of the barrier 100 has been drained in a manner similar to FIG. 2A. However, the water 108 that is in the pit region of the barrier 100 has been retained.

Figure 4A:
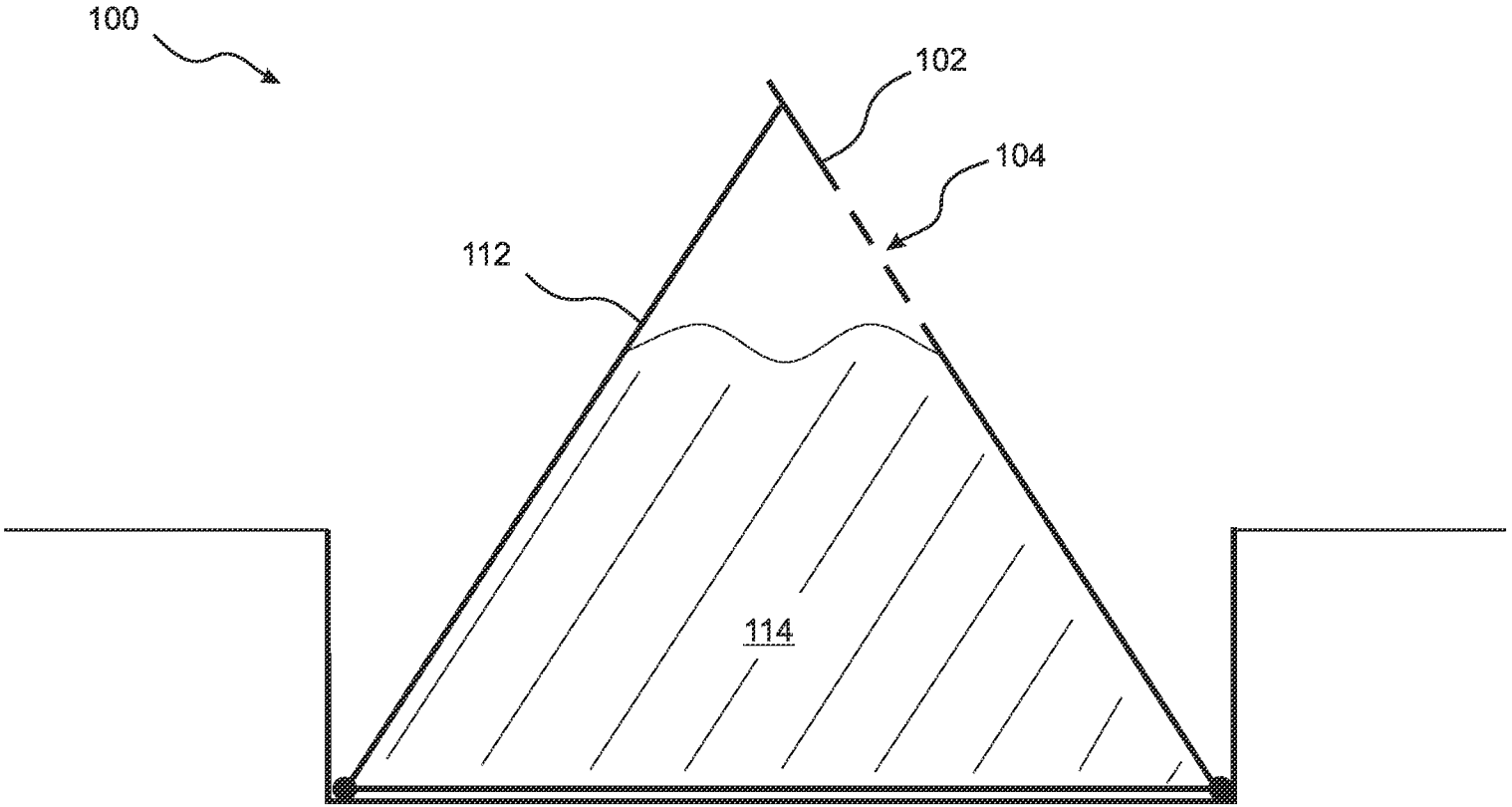
FIG. 4A is a cross-sectional view of an embodiment installed in a sump or pit and configured to form a stowed configuration that is below grade, the embodiment being shown in a deployed configuration.
Figure 4B:
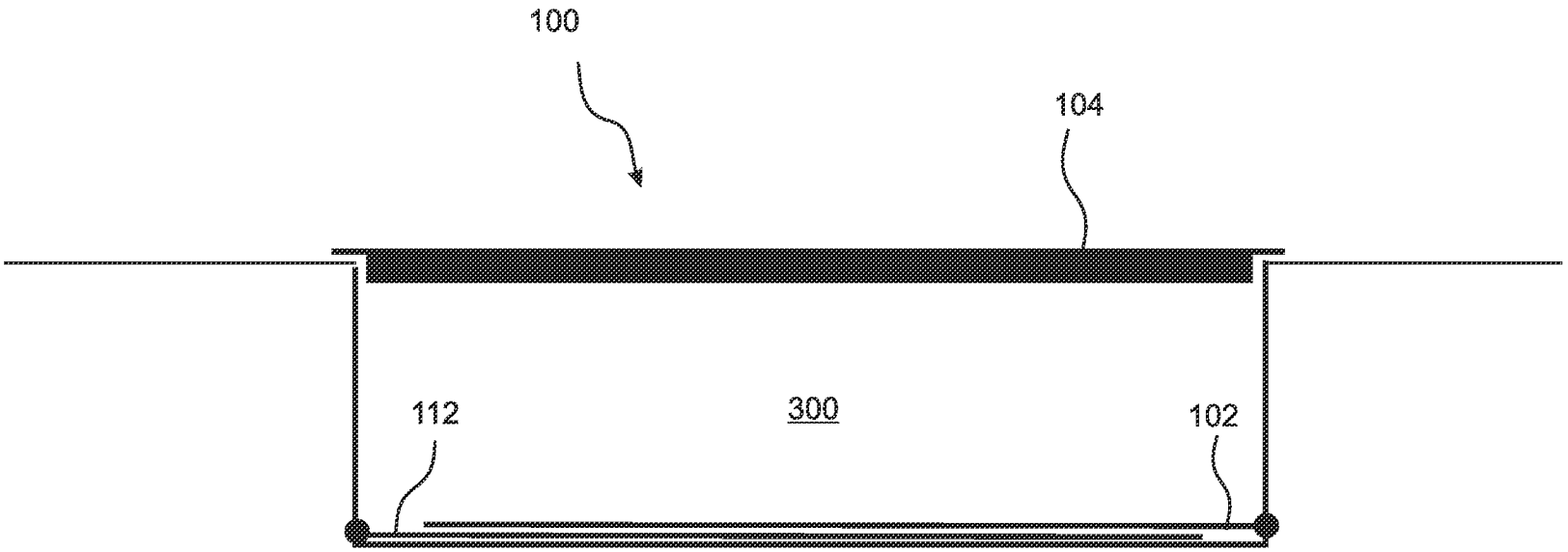
FIG. 4B is a cross-sectional view of the embodiment of FIG. 4A illustrating the embodiment in its stowed configuration with the sump or pit being covered by a lid having an upper surface that is substantially at grade.

With reference to FIG. 4A, in similar embodiments the lower edges of the front 102, rear 112, and side 118 walls are located within the pit 300, such that when not in use, the barrier 100 can be folded or disassembled and stacked within the pit 300 below grade. With reference to FIG. 4B, a lid 400 can then be placed over the pit 300 or sump having a top that is substantially flush with the surrounding grade. As a result, when the barrier 100 is stowed in the pit 300, the lid 400 can be walked on, or in embodiments even driven over with a vehicle, such as a tractor pulling farm equipment.

Figure 5:
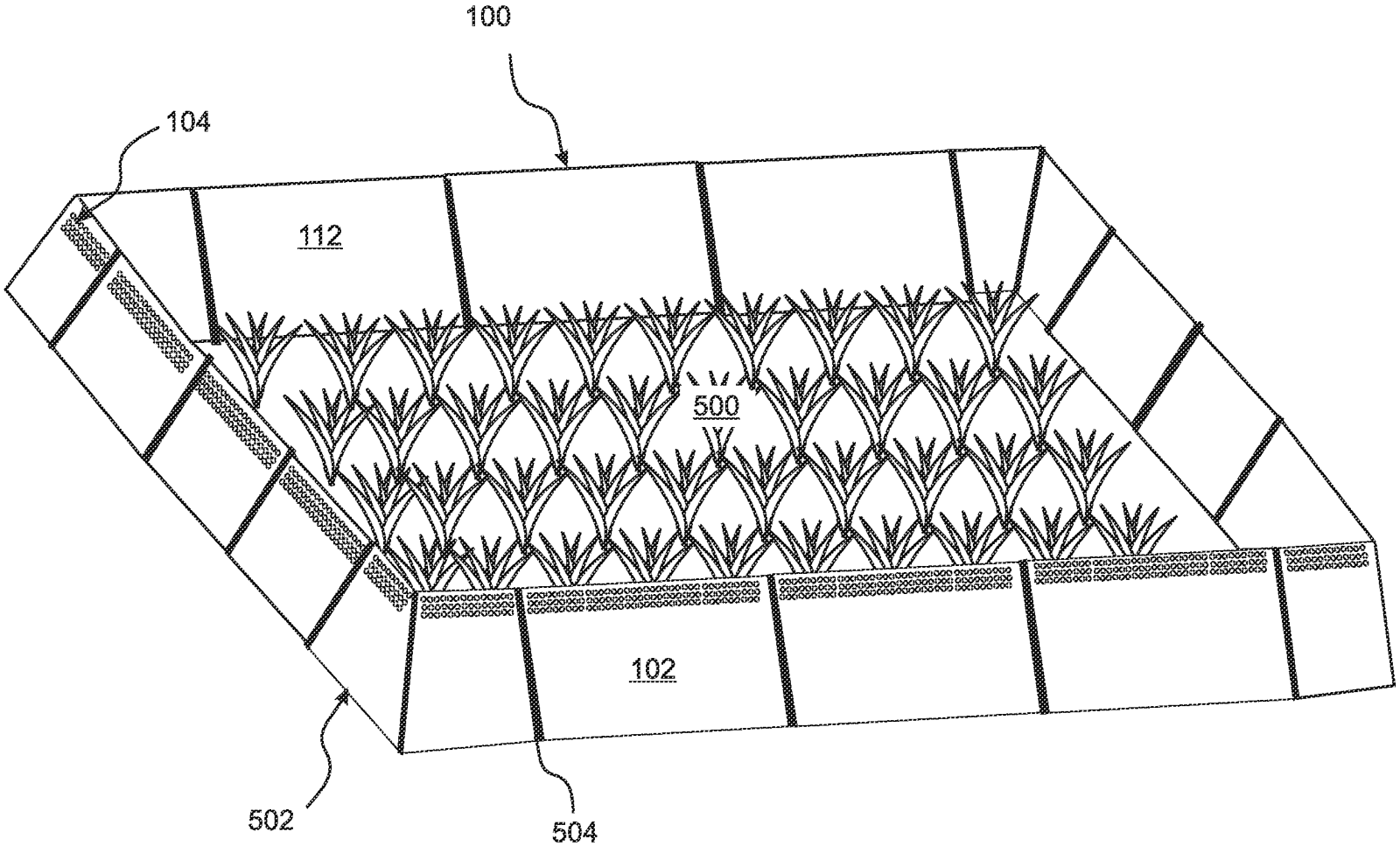
FIG. 5 is a perspective view of a plurality of modules according to the invention that have been joined to each other so as to surround a cultivated field.

With reference to FIG. 5, in embodiments a plurality of the disclosed barriers 100 can be joined and sealed end-on-end, for example by gaskets 504, to provide a more extended barrier, and/or to surround a house, field of cultivation 500, or other fixed asset that might be subject to flood waters on more than one side. In FIG. 5, the barriers 100 are arranged in a square configuration surrounding a field of cultivation 500 and joined to each other by gaskets 504, with right-angle barriers 502 being provided at the corners to complete the enclosure.

The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application.

The invention illustratively disclosed herein suitably may be practiced in the absence of any element which is not specifically disclosed herein and is not inherently necessary. However, this specification is not intended to be exhaustive. Although the present application is shown in a limited number of forms, the scope of the invention is not limited to just these forms, but is amenable to various changes and modifications without departing from the spirit thereof. One of ordinary skill in the art should appreciate after learning the teachings related to the claimed subject matter contained in the foregoing description that many modifications and variations are possible in light of this disclosure. Accordingly, the claimed subject matter includes any combination of the above-described elements in all possible variations thereof, unless otherwise indicated herein or otherwise clearly contradicted by context. In particular, the limitations presented in dependent claims below can be combined with their corresponding independent claims in any number and in any order without departing from the scope of this disclosure, unless the dependent claims are logically incompatible with each other.

What is claimed is:

1. A flood containment barrier module comprising:

a rigid or semi-rigid front wall having a top, a bottom, and two sides, the front wall being inclined backward at an angle of at least 20 degrees from vertical;

a plurality of holes penetrating the barrier wall proximate the top thereof;

a rear wall having a top, a bottom, and two sides;

two side walls having left and right edges that are removably joined to the sides of the front and rear walls by gaskets that form watertight seals; and a base wall joined to, and forming a watertight seal with, the bottoms of the front and rear walls and the side walls, so that a chamber space is formed between and bounded by the front and rear walls, the side walls, and the base wall, said chamber space being watertight up to a vertical level immediately below the plurality of holes;

the module being configured such that flood waters in contact with the front wall will flow into the interior when a height of the flood waters exceeds a height of the plurality of holes, the interior being thereby filled with water that is retained when the height of the flood waters falls below the plurality of holes, a weight of the retained water serving to increase a resistance of the module to being laterally displaced by the flood waters.

2. The barrier module of claim 1, further comprising at least one anchor that forms an attachment between the barrier module and ground proximate the barrier module.

3. The barrier module of claim 2 wherein the at least one anchor is at least one stake that can be driven into the ground.

4. The barrier module of claim 1 wherein the rear wall is inclined from vertical in a forward direction, so that the top of the rear wall is in contact with the top of the front of the front wall, or with a rear surface of the front wall.

5. The barrier module of claim 1, wherein a thickness of the front wall is between one quarter inch and two inches.

6. The barrier module of claim 1, wherein at least one of the front wall, the rear wall, the side walls, and the base wall is made from plywood, metal, fiberglass, particle board, micro-lattice, rigid foam, Styrofoam, graphene, and/or plastic.

7. The barrier module of claim 1, wherein the holes have diameters that are between ¼ inch and 6 inches.

8. The barrier module of claim 1, wherein the front wall, the rear wall, and the side walls can be detached from each other and pivoted about their bottoms so as to overlap with each other in a substantially flat, stowed configuration.

9. The barrier module of claim 1, wherein the front wall, the rear wall, the side walls, and the base wall can be detached from each other and stacked on top of each other in a substantially flat, stowed configuration.

10. The barrier module of claim 1, wherein the module is configured for installation within a sump or pit.

11. The barrier module of claim 10, wherein the front wall, the rear wall, and the side walls can overlap with each other in a substantially flat, stowed configuration that lies even with or below a surrounding grade.

12. The barrier module of claim 11, wherein, when the barrier module is in the stowed configuration it is below grade, and wherein the barrier module further comprises a lid that is configured to cover the sump or pit.

13. The barrier module of claim 12, wherein when the lid is covering the sump or pit, a top of the lid is substantially even with the surrounding grade.

14. A flood containment structure comprising:

a plurality of barrier modules, each of the barrier modules comprising:

a rigid or semi-rigid front wall having a top, a bottom, and two sides, the front wall being inclined backward at an angle of at least 20 degrees from vertical;

a plurality of holes penetrating the barrier wall proximate the top thereof;

a rear wall having a top, a bottom, and two sides, an interior of the barrier module being formed between the front and rear walls; and a base wall joined to, and forming a watertight seal with, the bottoms of the front and rear walls;

the barrier module being configured such that flood waters in contact with the front wall will flow into the interior when a height of the flood waters exceeds a height of the plurality of holes, the interior being thereby filled with water that is retained when the height of the flood waters falls below the plurality of holes;

wherein the modules are arranged side-by-side, with adjacent front and rear walls of the barrier modules being joined to each other by watertight gasket seals, such that the plurality of modules are combined into an extended flood barrier that is watertight up to a vertical level immediately below the plurality of holes.

15. The structure of claim 14, wherein the side walls are closer to each other than opposing sides of the front and rear walls and bottom, such that the front and rear walls and the base wall extend beyond the side walls.

16. The structure of claim 15, wherein at least one adjacent pair of the plurality of modules are joined together by a gasket into which sides of the front and rear walls and the bottom are inserted.

17. The structure of claim 14, wherein at least some of the modules further comprise at least one side wall having left and right edges that are joined to the sides of the front and rear walls.

18. The structure of claim 14, wherein at least some of the modules do not include side walls, such that a common interior space is formed between the modules when they are joined to each other.

* * * * *